US010435994B2

(12) United States Patent
Colvin et al.

(10) Patent No.: US 10,435,994 B2
(45) Date of Patent: Oct. 8, 2019

(54) SYSTEMS AND METHODS FOR OPTIMAL SPACING OF HORIZONTAL WELLS

(75) Inventors: Richard Daniel Colvin, Dripping Springs, TX (US); DeWayne Pratt, Littleton, CO (US)

(73) Assignee: Landmark Graphics Corporation, Houston, TX (US)

( * ) Notice: Subject to any disclaimer, the term of this patent is extended or adjusted under 35 U.S.C. 154(b) by 1169 days.

(21) Appl. No.: 14/398,909

(22) PCT Filed: May 4, 2012

(86) PCT No.: PCT/US2012/036538
§ 371 (c)(1),
(2), (4) Date: Nov. 4, 2014

(87) PCT Pub. No.: WO2013/165437
PCT Pub. Date: Nov. 7, 2013

(65) Prior Publication Data
US 2015/0114630 A1 Apr. 30, 2015

(51) Int. Cl.
*E21B 41/00* (2006.01)
*E21B 43/30* (2006.01)

(52) U.S. Cl.
CPC ..... *E21B 41/0092* (2013.01); *E21B 43/305* (2013.01)

(58) Field of Classification Search
CPC ..... E21B 41/0092; E21B 43/305
USPC ..... 166/250.01
See application file for complete search history.

(56) References Cited

U.S. PATENT DOCUMENTS

| | | | | |
|---|---|---|---|---|
| 4,889,186 | A | 12/1989 | Hanson et al. | |
| 7,059,407 | B2 | 6/2006 | Tolman et al. | |
| 7,228,908 | B2 * | 6/2007 | East, Jr. | E21B 43/16 166/271 |
| 2007/0294034 | A1 | 12/2007 | Bratton et al. | |
| 2008/0236270 | A1 | 10/2008 | Denichou et al. | |
| 2010/0108310 | A1 * | 5/2010 | Fowler | E21B 43/2401 166/245 |
| 2010/0312478 | A1 | 12/2010 | Tabanou et al. | |

FOREIGN PATENT DOCUMENTS

| | | | | |
|---|---|---|---|---|
| CA | 2871104 | A1 * | 11/2013 | E21B 41/0092 |
| CA | 2871104 | A1 | 11/2013 | |
| WO | 2011115600 | A1 | 9/2011 | |
| WO | WO-2011115600 | A1 * | 9/2011 | E21B 43/2406 |

OTHER PUBLICATIONS

International Search Report and Written Opinion for International Application No. PCT/US12/36538 dated Aug. 31, 2012, (18 pages).

(Continued)

*Primary Examiner* — Anna M Momper
*Assistant Examiner* — Patrick F Lambe
(74) *Attorney, Agent, or Firm* — Kilpatrick Townsend & Stockton LLP

(57) ABSTRACT

Systems and methods for optimal spacing of horizontal wells that maximizes coverage of a predetermined area within an irregular boundary by the horizontal wells.

22 Claims, 5 Drawing Sheets

(56) References Cited

OTHER PUBLICATIONS

International Preliminary Report on Patentability for International Application No. PCT/US12/36538 dated Oct. 31, 2014, (16 pages).
Australia Examination Report No. 1 dated Jul. 20, 2015 for Australian Application No. 2012379048 (3 pages).
Response to Australia Examination Report 1 filed on Aug. 10, 2015 for Australian Application No. 2012379048 (5 pages).
Canada Examination Report dated Dec. 22, 2015 for Canadian Application No. 2871104 (4 pages).
Response to Canadian Examination Report for Canadian Application No. 2871104 (17 pages).
Russia Office Action dated Jan. 11, 2016 for Russian Application No. 2014141366/03(067043) (12 pages).
Response to Russian Office Action received on Mar. 10, 2016 for Russian Application No. 2014141366/03(067043) (9 pages).

* cited by examiner

SYSTEMS AND METHODS FOR OPTIMAL SPACING OF HORIZONTAL WELLS

CROSS-REFERENCE TO RELATED APPLICATIONS

This application and PCT Patent Application No. PCT/US10/00774, which is incorporated herein by reference, are commonly assigned to Landmark Graphics Corporation. This application claims the priority of PCT Patent Application No. PCT/US2012/36538, filed on May 4, 2012, which is incorporated herein by reference.

STATEMENT REGARDING FEDERALLY SPONSORED RESEARCH

Not applicable.

FIELD OF THE INVENTION

The present invention generally relates to systems and methods for optimal spacing of horizontal wells. More particularly, the present invention relates to optimal spacing of horizontal wells that maximizes coverage of a predetermined area within an irregular boundary by the horizontal wells.

BACKGROUND OF THE INVENTION

In today's oil and gas industry, wells that are deviated are most common and, more often than not, are deviated to horizontal. A horizontal well is typically straight and relatively flat over the final portion that extends between the heel and the toe. The shape prior to the heel will be whatever is necessary to get from the surface location to that heel, building to an inclination of roughly 90 degrees and turning to the intended azimuth, achieving both by the time the heel is reached. The heel and the toe may be referred to as endpoints and the portion between the heel and toe may be referred to as a lateral.

There are a number of established plays that utilize mass planning and targeting for horizontal drilling like the SAGD (steam assisted gravity drainage) in Canada and the Marcellus, Hornriver and Barnett shale gas plays. In order to optimize the number of wells to completely exploit one of these plays, companies are planning hundreds, and in some case thousands, of wells for an entire field, which is often very time-consuming and requires numerous resources. A field development plan therefore, will typically attempt to fill one or more predetermined polygonal areas with horizontal wells. An example of such a polygonal area is the area within a lease boundary, which has been reduced by a 'setback' distance (the minimum distance that all wells must be from the lease boundary). Each segment between any two sequential edge points along the boundary is thus, referred to as a boundary segment.

There are numerous types of resource plays that require laterals to be positioned and spaced to fill a lease boundary. Two specific plays that utilize the placement of laterals are shale and heavy oil plays. The objective is to maximize the production coverage within the lease boundary based on lateral constraints, such as min/max lateral lengths, lateral spacing and heel, toe, heel,heel or toe,toe spacing. In order to fully maximize the production coverage, the horizontal wells are laterally spaced in proportion while maintaining extremely accurate subsurface depth. Likewise, the available surface locations and surface/subsurface hazards must be taken into account when positioning the horizontal wells.

In order to address the foregoing concerns, conventional techniques, like that described in WIPO Patent Application Publication No. WO 2011/115600, have applied horizontal targeting to fill a predetermined area, within a regular or irregular boundary, with horizontal wells. The horizontal targeting initially considers the boundary filling as a two-dimensional (2D) problem. In FIG. 3, a plan view 300 illustrates a predetermined area within an irregular boundary filled by horizontal wells using a conventional technique. As demonstrated by the open areas 302, conventional techniques may not maximize the production coverage of the predetermined area by the horizontal wells because the predetermined area lies within an irregular boundary, the horizontal wells must always be parallel and/or the laterals must all have the same length.

SUMMARY OF THE INVENTION

The present invention therefore, meets the above needs and overcomes one or more deficiencies in the prior art by providing systems and methods for optimal spacing of horizontal wells that maximizes coverage of a predetermined area within an irregular boundary by the horizontal wells.

In one embodiment, the present invention includes a method for optimally spacing horizontal wells within an irregular boundary, which comprises: i) determining boundary segments for the irregular boundary that fall within a correct azimuth range using a computer processor; ii) determining whether a heel, toe pair for a horizontal well should be repositioned based on the boundary segments that fall within the correct azimuth range; and iii) repositioning the heel, toe pair so that the heel, toe pair is not parallel to another heel, toe pair for another horizontal well nearest the heel, toe pair.

In another embodiment, the present invention includes a non-transitory program carrier device tangibly carrying computer executable instructions for optimally spacing horizontal wells within an irregular boundary, the instructions being executable to implement: i) determining boundary segments for the irregular boundary that fall within a correct azimuth range; ii) determining whether a heel, toe pair for a horizontal well should be repositioned based on the boundary segments that fall within the correct azimuth range; and iii) repositioning the heel, toe pair so that the heel, toe pair is not parallel to another heel, toe pair for another horizontal well nearest the heel, toe pair.

Additional aspects, advantages and embodiments of the invention will become apparent to those skilled in the art from the following description of the various embodiments and related drawings.

BRIEF DESCRIPTION OF THE DRAWINGS

The present invention is described below with references to the accompanying drawings in which like elements are referenced with like reference numerals, and in which.

DETAILED DESCRIPTION OF THE PREFERRED EMBODIMENTS

The subject matter of the preferred embodiments is described with specificity however, is not intended to limit the scope of the invention. The subject matter thus, might also be embodied in other ways to include different steps, or combinations of steps, similar to the ones described herein, in conjunction with other present or future technologies. Although the term "step" may be used herein to describe different elements of methods employed, the term should not be interpreted as implying any particular order among or between various steps herein disclosed unless otherwise expressly limited by the description to a particular order. While the following description refers to oil and gas wells, the systems and methods of the present invention are not limited thereto and may also be applied to other industries to achieve similar results.

Method Description

Figure 1:
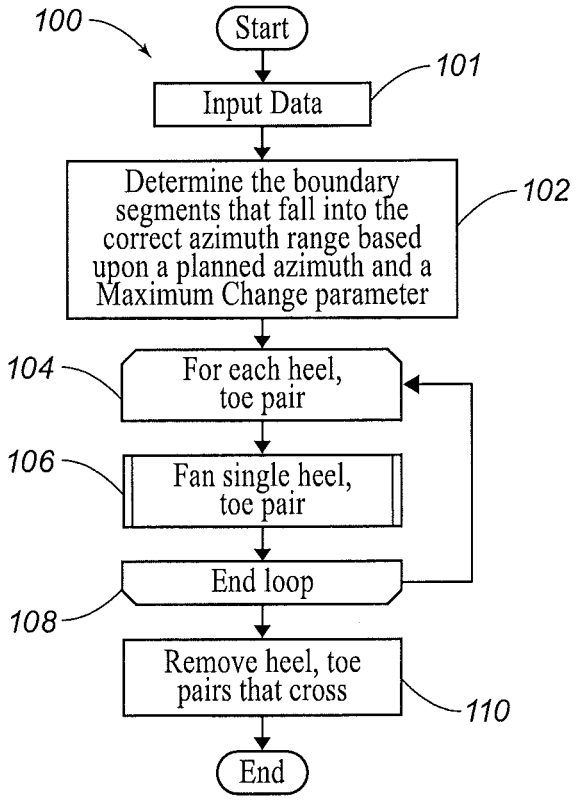
FIG. 1 is a flow diagram illustrating one embodiment of a method for implementing the present invention.

Referring now to FIG. 1, a flow diagram of one embodiment of a method 100 for implementing the present invention is illustrated. The method 100 generally illustrates a fanning technique while still working with 2D coordinates, such that the horizontal wells that are fanned in 2D wind up being properly reflected in 3D. If the method 100 were applied after moving to a 3D model, the amount of labor to accomplish the method 100 would require substantially more work, including shifting the intermediate targets to keep the horizontal wells straight, checking for horizontal wells that have become too close due to the pivoting, depth shifting all targets to maintain proper vertical relationships to the geology and checking against depth specific hazards, for example. The method 100 therefore, occurs between laying out the 2D horizontal wells and processing each heel, toe pair into 3D well path segments so the data can be modified to move from completely parallel heel, toe pairs to a fan fill pattern. Because depths have not been established for the x,y locations of the lateral heels and toes, nor any intermediate points for insuring that the lateral tracks the geology, the term "heel, toe pair" is used herein to describe each lateral.

Figure 6:
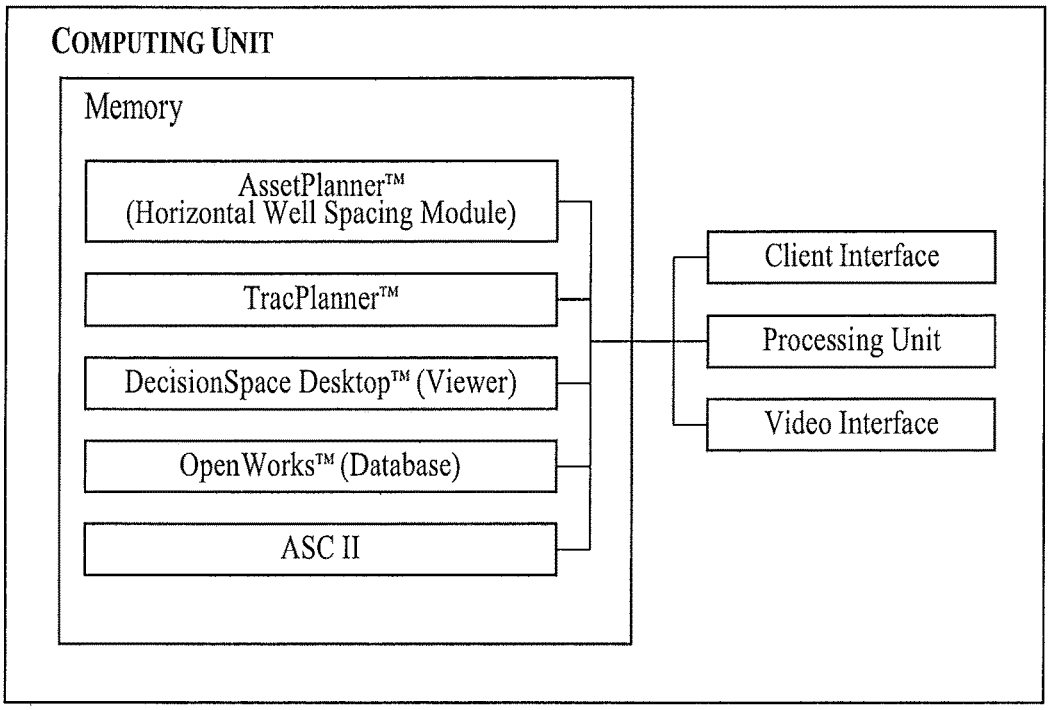
FIG. 6 is a block diagram illustrating one embodiment of a computer system for implementing the present invention.

In step 101, data is input for the method 100 using the client interface and/or the video interface described in reference to FIG. 6. The input data may include, but is not limited to: i) a boundary comprising boundary segments, wherein the edge points are reflected in x,y coordinates; ii) sets of predetermined heel, toe pairs for each horizontal well, wherein each endpoint is reflected as an x,y location; iii) an effective range ("RangeDistance"), which represents the maximum distance in from the boundary that a lateral could be positioned and still considered for fanning; iv) a maximum change parameter ("MaximumChange"), which represents the maximum amount a planned azimuth may be altered in degrees; v) a movement percentage parameter ("MovementPercentage"), which represents the amount of shift desired in an attempt to line up the fanned endpoints (100%) compared to lining up the pivot endpoints (0%); and vi) a planned azimuth and additional data that may impact positioning the horizontal wells such as, for example, maximum reach to heel, minimum and maximum lateral lengths, beginning heel,heel and toe,toe spacing, required hazard clearance distance, and a boundary setback distance.

In step 102, boundary segments that fall into the correct azimuth range are determined. The boundary segments that fall into the correct azimuth range may be determined based upon the planned azimuth and the MaximumChange parameter from step 101. Using this data, the boundary segments that fall into the correct azimuth range may be determined by the azimuth for each boundary segment and whether it falls within the Maximum Change of the planned azimuth but not including the planned azimuth. The planned azimuth is the azimuth being used for the horizontal well spacing. Thus, if a planned azimuth of 295° is used, along with a Maximum Change of 30°, then any boundary segment will be considered within the correct azimuth range if the azimuth for that boundary segment is between 265° and 325°. Likewise, the boundary segment will be considered within the correct azimuth range if the azimuth for the boundary segment is within that same 265° to 325° range. Any boundary segment that has an azimuth of exactly 295° will not be considered within the correct azimuth range, however, because the heel, toe pair will already be parallel to it.

In step 104, the method 100 selects a heel, toe pair from the data in step 101 for step 106. The method may select the head, tow pair at random or using any other predetermined criteria.

Figure 2A:
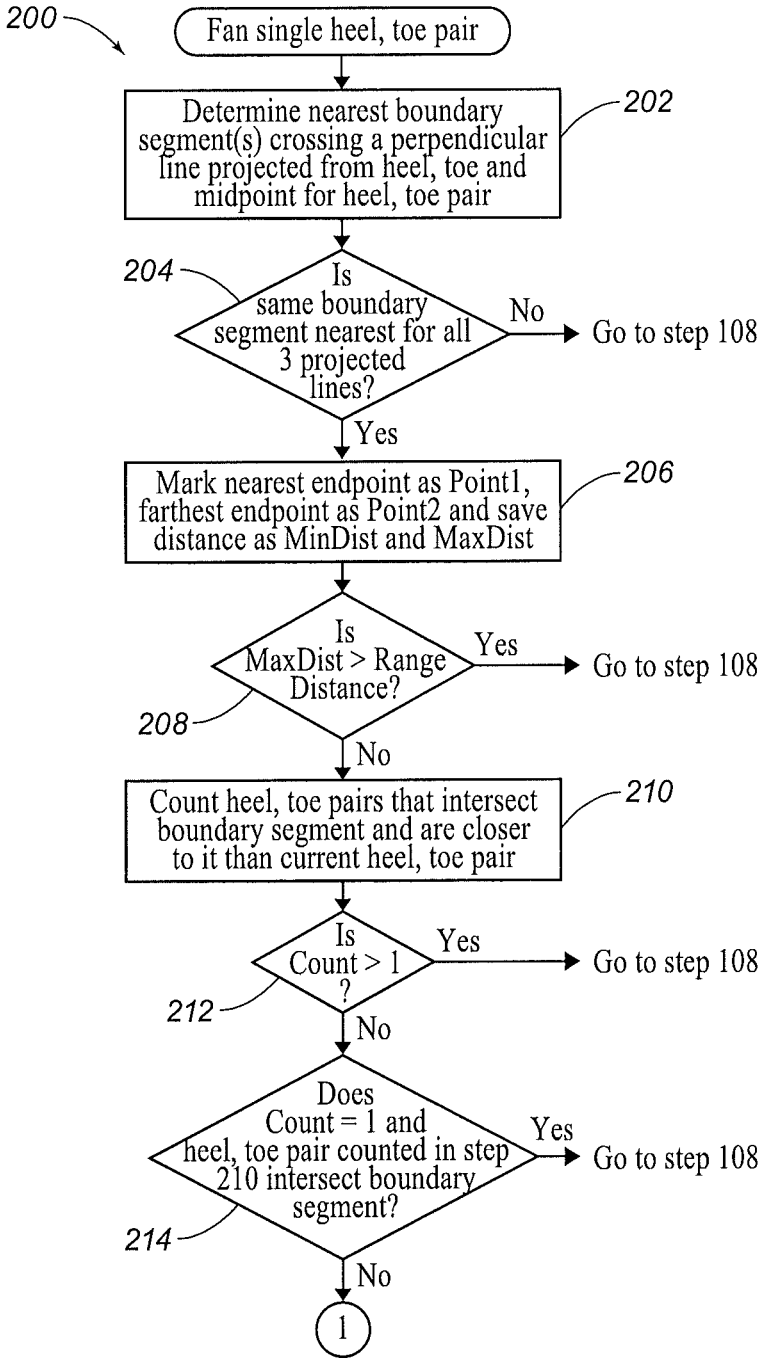
FIG. 2A is a flow diagram illustrating one embodiment of an algorithm for performing step 106 in FIG. 1.
Figure 2B:
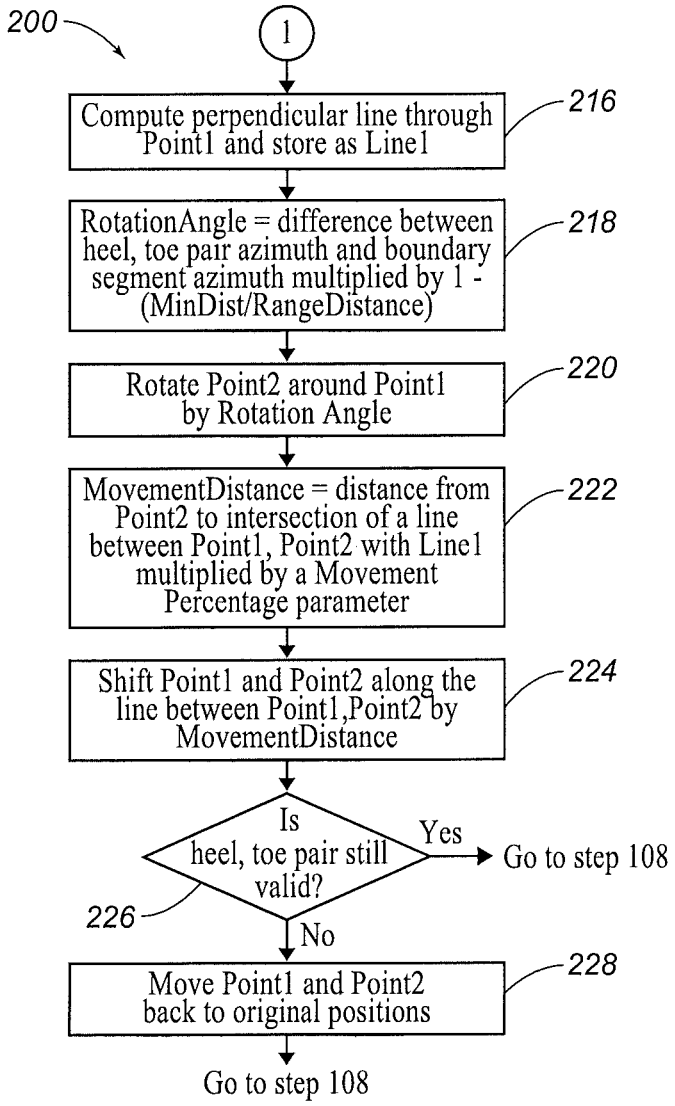
FIG. 2B is a continuation of the flow diagram illustrated in FIG. 2A.

In step 106, the "fan single heel, toe pair" algorithm is executed for the heel, toe pair selected in step 104, which is described further in reference to FIGS. 2A-2B.

In step 108, the method 100 determines if additional heel, toe pairs are available from the data in step 101. If there are additional heel, toe pairs, then the method 100 returns to step 104 to select another heel, toe pair. If there are no additional heel, toe pairs, then the method 100 proceeds to step 110.

In step 110, each heel, toe pair that crosses another heel, toe pair as a result of the fanning in step 106 is removed and the method 100 ends. As a result, each horizontal well with a heel, toe pair that is removed, is removed from the predetermined area within the boundary. Preferably, the heel, toe pair that crosses the most heel, toe pairs is removed first and if there are any heel, toe pairs that cross the same number of heel, toe pairs (e.g. each crossing one another) either or both may be removed.

Referring now to FIG. 2A, a flow diagram of one embodiment of the "fan single heel, toe" algorithm for performing step 106 in FIG. 1 is illustrated. The method 200 generally operates on the basic premise that the optimum placement of horizontal wells over a predetermined area, where the irregular boundary is not necessarily parallel or perpendicular to the planned azimuth, begins with a layout of parallel horizontal wells and, in areas where it is appropriate to do so, fans the horizontal wells by pivoting around either the heel or toe such that there is an increasing deviation away from the planned azimuth toward the azimuth of the nearest boundary segment. Appropriate areas for performing the method 200 are thus, areas where there is a nearby boundary segment that has an azimuth less than a user specified delta from the planned azimuth and where there are multiple horizontal wells from the same row intersecting the boundary segment.

In step 202, the nearest boundary segment(s) crossing a perpendicular line projected from the heel, toe and a midpoint between the heel, toe are determined. Thus, for the heel, toe pair selected in step 104, three lines are projected perpendicular from the heel, toe and the midpoint between the heel, toe to determine the nearest boundary segment(s) from step 102 that cross(es) the three projected lines.

In step 204, the method 200 determines if the same boundary segment is nearest for all three projected lines. If the same boundary segment is not nearest for all three projected lines, then the method 200 returns to step 108 because the boundary segments determined in step 202 are not consistent and near enough to this heel, toe pair for the method 200 to be effective. If the same boundary segment is nearest for all three projected lines, then the method 200 proceeds to step 206.

In step 206, the endpoint of the heel, toe pair selected in step 104 that is nearest the boundary segment determined in step 202 is marked as Point1 and the endpoint of the heel, toe pair selected in step 104 that is farthest from the boundary segment determined in step 202 is marked as Point2. In addition, the distance from the nearest endpoint to the boundary segment determined in step 202 is saved as MinDist and the distance from the farthest endpoint to the boundary segment determined in step 202 is saved as MaxDist.

In step 208, the method 200 determines if MaxDist is greater than the RangeDistance from step 101. If MaxDist is greater than RangeDistance, then the method 200 returns to step 108 because the heel, toe pair selected in step 104 is too far from the boundary segment determined in step 202. If MaxDist is not is greater than RangeDistance, then the method 200 proceeds to step 210.

In step 210, the heel, toe pairs that intersect the boundary segment determined in step 202 and are closer to it than the heel, toe pair selected in step 104 are counted. Thus, for the first iteration of the method 200, there will be zero heel, toe pairs that intersect the boundary segment determined in step 210 and are closer to it than the heel, toe pair selected in step 104.

In step 212, the method 200 determines if the count ("Count") from step 210 is greater than 1. If the Count is greater than 1, then the method 200 returns to step 108 because a series of heel, toe pairs that all intersect the same boundary segment, when fanned, will compress and be effectively useless in terms of production coverage. If the Count is not greater than 1, then the method 200 proceeds to step 214.

In step 214, the method 200 determines if the Count is equal to 1 and if the heel, toe pair counted in step 210 intersects the boundary segment determined in step 202. If the Count is equal to 1 and if the heel, toe pair counted in step 210 intersects the boundary segment determined in step 202, then the method 200 returns to step 108. If the Count is not equal to 1 or if the Count is equal to 1, but the heel, toe pair counted in step 210 does not intersect the boundary segment determined in step 202, then the method 200 proceeds to step 216 in FIG. 2B.

In step 216, a line that is perpendicular to the heel, toe pair selected step 104 is computed through Point1. This perpendicular line is stored as Line1.

In step 218, RotationAngle is set equal to the difference between the planned azimuth for the heel, toe pair selected in step 104 and an azimuth for the boundary segment determined in step 202 multiplied by 1−(MinDist/RangeDistance). RotationAngle is thus, the amount that Point2 is going to be rotated about Point1. In this manner, the heel, toe pair selected in step 104 will be rotated all the way into the boundary segment determined in step 202 when the heel, toe pair is close enough to the boundary segment. If, however, the heel, toe pair selected in step 104 is at the RangeDistance, then it will not be rotated at all.

In step 220, Point2 is rotated around Point1 by the RotationAngle.

In step 222, MovementDistance is set equal to the distance from Point2 to an intersection of a line between Point1 and Point2 with Line1 multiplied by the Movement Percentage parameter from step 101. Because the fanning represented by the method 200 takes heel, toe pairs that were formally lined up in straight rows with rows of heels aligned and rows of toes aligned, and pivots them in manner that leaves corners within the boundary uncovered, it may be desirable to shift the fanned heel, toe pair such that Point1 is moved toward Point2 and Point2 is moved toward a position that is aligned with the row of which it was formerly a part. The shifting therefore, is based upon the Movement Percentage parameter, wherein 0% is no shifting and 100% is shifting all the way so that the rotated points maintain alignment.

In step 224, Point1 and Point2 are shifted along the line between Point1, Point2 by the MovementDistance.

In step 226, the method 200 determines if the heel, toe pair selected in step 104 is still valid—meaning both the heel and the toe from the heel, toe pair are in valid positions wherein the heel, toe pair does not intersect the irregular boundary or any hazard. If the heel, toe pair selected in step 104 is still valid, then the method 200 returns to step 108. If the heel, toe pair is not still valid, then the method 200 proceeds to step 228.

In step 228, Point1 and Point2 are shifted back to their original positions because the heel, toe pair is not still valid, and the method 200 returns to step 108.

Figure 3:
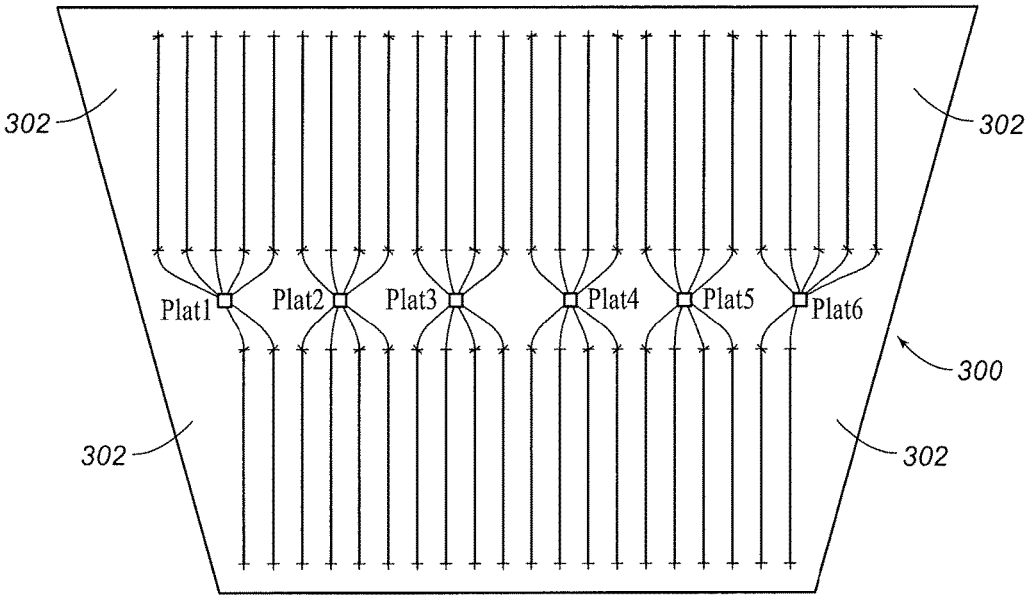
FIG. 3 Prior Art
FIG. 3 is a plan view illustrating a predetermined area within an irregular boundary filled by horizontal wells using a conventional technique.
Figure 4:
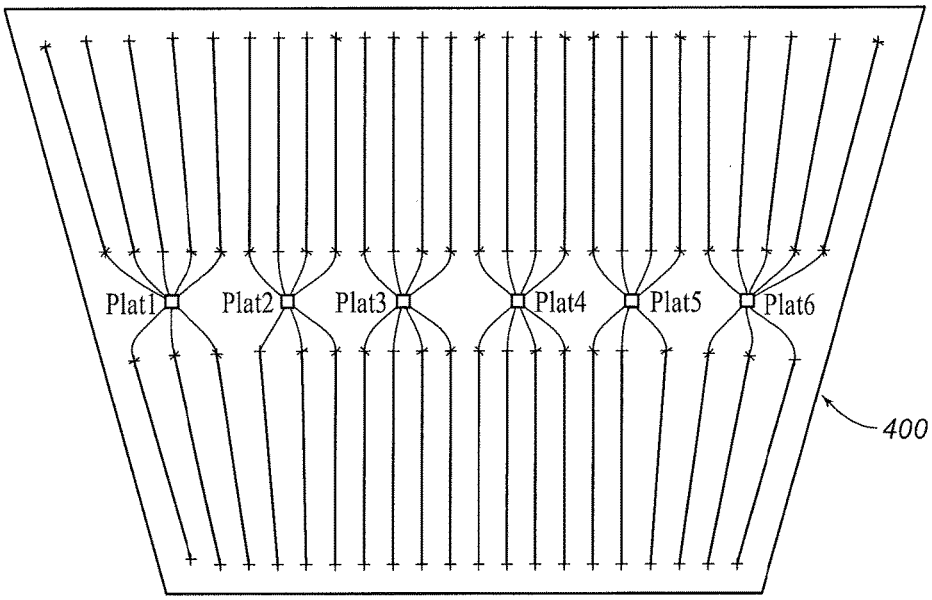
FIG. 4 is a plan view illustrating the predetermined area in FIG. 3 filled by horizontal wells using the present invention.
Figure 5:
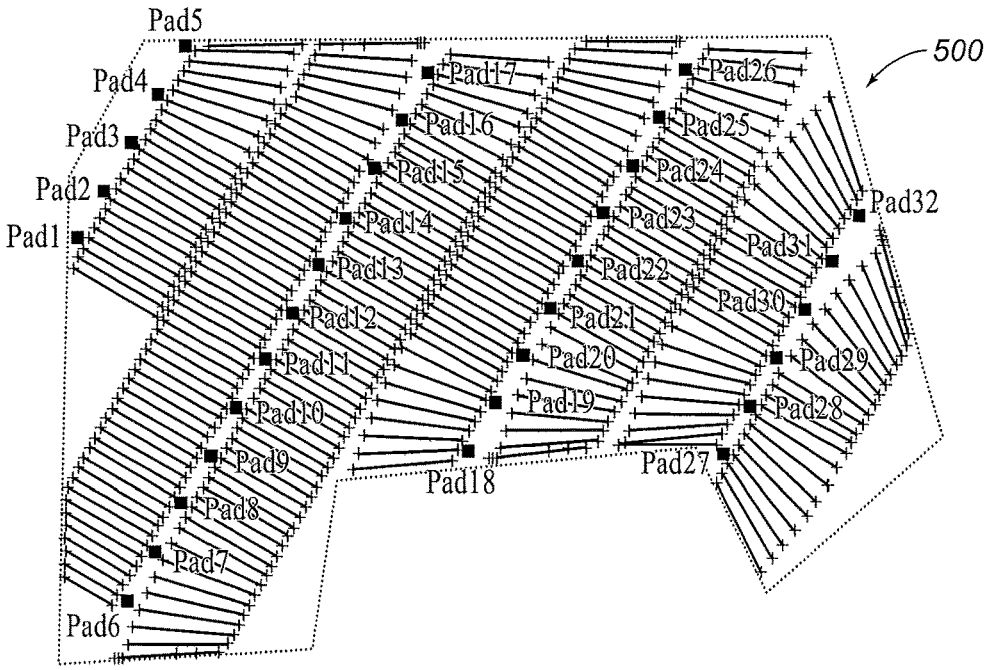
FIG. 5 is a plan view illustrating another predetermined area within an irregular boundary filled by horizontal wells using the present invention.

As illustrated by a comparison of the plan view 300 in FIG. 3 and the plan view 400 in FIG. 4, the open areas 302 in FIG. 3 are now covered by adding heel, toe pairs and fanning existing heel, toe pairs in the open areas 302 within the irregular boundary. Another example of the method 200 is illustrated by the plan view 500 in FIG. 5 of another predetermined area within an irregular boundary filled by horizontal wells. The method 200 therefore, determines the best lateral spacing for horizontal wells to maximize production coverage across an area within an irregular boundary, while positioning each individual target at varied subsurface depths. This lateral spacing can also be adjusted to complete a pattern that maximizes production coverage within the irregular boundary.

System Description

The present invention may be implemented through a computer-executable program of instructions, such as program modules, generally referred to as software applications or application programs executed by a computer. The software may include, for example, routines, programs, objects, components, and data structures that perform particular tasks or implement particular abstract data types. The software forms an interface to allow a computer to react according to a source of input. AssetPlannerm, which is a commercial software application marketed by Landmark Graphics Corporation, may be used as an interface application to implement the present invention. The software may also cooperate with other code segments to initiate a variety of tasks in response to data received in conjunction with the source of the received data. The software may be stored and/or carried on any variety of memory media such as CD-ROM, magnetic disk, bubble memory and semiconductor memory (e.g., various types of RAM or ROM). Furthermore, the software and its results may be transmitted over a variety of carrier media such as optical fiber, metallic wire and/or through any of a variety of networks such as the Internet.

Moreover, those skilled in the art will appreciate that the invention may be practiced with a variety of computer-system configurations, including hand-held devices, multiprocessor systems, microprocessor-based or programmable-consumer electronics, minicomputers, mainframe computers, and the like. Any number of computer-systems and computer networks are acceptable for use with the present invention. The invention may be practiced in distributed-computing environments where tasks are performed by remote-processing devices that are linked through a communications network. In a distributed-computing environment, program modules may be located in both local and remote computer-storage media including memory storage devices. The present invention may therefore, be implemented in connection with various hardware, software or a combination thereof, in a computer system or other processing system.

Referring now to FIG. 6, a block diagram of one embodiment of a system for implementing the present invention on a computer is illustrated. The system includes a computing unit, sometimes referred to as a computing system, which contains memory, application programs, a database, a viewer, ASCII files, a client interface, a video interface and a processing unit. The computing unit is only one example of a suitable computing environment and is not intended to suggest any limitation as to the scope of use or functionality of the invention.

The memory primarily stores the application programs, which may also be described as program modules containing computer-executable instructions, executed by the computing unit for implementing the present invention described herein and illustrated in FIGS. 1, 2A-2B and 4-5. The memory therefore, includes OpenWorks™, which may be used as a database to supply data and/or store data results such as, for example, the input data and horizontal well spacing plans. ASCII files may also be used to supply data and/or store the data results. The memory also includes DecisionSpace Desktop™, which may be used as a viewer to display the data and data results. The horizontal well spacing module in AssetPlanner™ uses the input data to determine the spacing and positioning requirements for the horizontal wells. In one application, for example, polygonal areas representing a predetermined area within an irregular lease boundary may be drawn directly in DecisionSpace Desktop™ using the client interface and TracPlanner™. In another application, for example, a polygonal area representing a predetermined area within an irregular lease boundary could be defined directly in TracPlanner™ using the client interface or by importing it from the ASCII files as specified by the client interface. Once the boundary is defined, the client interface may be used to enter other horizontal well spacing parameters. These parameters may dictate the desired horizontal well lengths, spacing and azimuth, which are processed by the horizontal well spacing module in AssetPlanner™ to generate an optimal horizontal well spacing plan. The horizontal well spacing module thus, processes the input data using the methods described in reference to FIGS. 1 and 2A-2B to generate the optimal horizontal well spacing plan. Although AssetPlanner™ may be used to determine the spacing and positioning requirements for horizontal wells, other interface applications may be used, instead, or the horizontal well spacing module may be used as a stand-alone application. TracPlanner™, DecisionSpace Desktop™ and OpenWorks™ are commercial software applications marketed by Landmark Graphics Corporation.

Although the computing unit is shown as having a generalized memory, the computing unit typically includes a variety of computer readable media. By way of example, and not limitation, computer readable media may comprise computer storage media. The computing system memory may include computer storage media in the form of volatile and/or nonvolatile memory such as a read only memory (ROM) and random access memory (RAM). A basic input/output system (BIOS), containing the basic routines that help to transfer information between elements within the computing unit, such as during start-up, is typically stored in ROM. The RAM typically contains data and/or program modules that are immediately accessible to and/or presently being operated on by the processing unit. By way of example, and not limitation, the computing unit includes an operating system, application programs, other program modules, and program data.

The components shown in the memory may also be included in other removable/nonremovable, volatile/nonvolatile computer storage media or they may be implemented in the computing unit through an application program interface ("API") or cloud computing, which may reside on a separate computing unit connected through a computer system or network. For example only, a hard disk drive may read from or write to nonremovable, nonvolatile magnetic media, a magnetic disk drive may read from or write to a removable, nonvolatile magnetic disk, and an optical disk drive may read from or write to a removable, nonvolatile optical disk such as a CD ROM or other optical media. Other removable/non-removable, volatile/nonvolatile computer storage media that can be used in the exemplary operating environment may include, but are not limited to, magnetic tape cassettes, flash memory cards, digital versatile disks, digital video tape, solid state RAM, solid state ROM, and the like. The drives and their associated computer storage media discussed above provide storage of computer readable instructions, data structures, program modules and other data for the computing unit.

A client may enter commands and information into the computing unit through the client interface, which may be input devices such as a keyboard and pointing device, commonly referred to as a mouse, trackball or touch pad. Input devices may include a microphone, joystick, satellite dish, scanner, or the like. These and other input devices are often connected to the processing unit through a system bus, but may be connected by other interface and bus structures, such as a parallel port or a universal serial bus (USB).

A monitor or other type of display device may be connected to the system bus via an interface, such as a video interface. A graphical user interface ("GUI") may also be used with the video interface to receive instructions from the client interface and transmit instructions to the processing unit. In addition to the monitor, computers may also include other peripheral output devices such as speakers and printer, which may be connected through an output peripheral interface.

Although many other internal components of the computing unit are not shown, those of ordinary skill in the art will appreciate that such components and their interconnection are well known.

While the present invention has been described in connection with presently preferred embodiments, it will be understood by those skilled in the art that it is not intended to limit the invention to those embodiments. Although the illustrated embodiments of the present invention relate to the positioning and spacing of horizontal oil and gas wells, the present invention may be applied to any other type of well in other fields and disciplines. It is therefore, contemplated that various alternative embodiments and modifications may be made to the disclosed embodiments without departing from the spirit and scope of the invention defined by the appended claims and the equivalents thereof.

The invention claimed is:

1. A computer-implemented method, the method comprising:

identifying one or more boundary segments of a hydrocarbon field development, wherein at least one boundary segment of the one or more boundary segments is an irregular boundary, and wherein the hydrocarbon field development includes a plurality of horizontal wells;

positioning a plurality of heel, toe pairs within the hydrocarbon field development having the irregular boundary, each heel, toe pair of the plurality of heel, toe pairs corresponding to a horizontal well of the plurality of horizontal wells, and the plurality of heel, toe pairs including a first heel, toe pair and a second heel, toe pair that are parallel to each other;

selecting the first heel, toe pair from amongst the plurality of heel, toe pairs;

determining whether the irregular boundary is within a correct azimuth range of the first heel, toe pair;

in response to determining that irregular boundary is within the correct azimuth range, determining that the first heel, toe pair should be repositioned so as to be parallel to an azimuth of the irregular boundary;

determining a rotation angle to rotate one end of the first heel, toe pair around another end of the first heel, toe pair, the rotation angle being determined so as to reposition the first heel, toe pair to be parallel to the azimuth of a boundary segment of the one or more boundary segments; and repositioning the first heel, toe pair by rotating the one end of the first heel, toe pair by the rotation angle so that the first heel, toe pair is not parallel to the second heel, toe pair, the second heel, toe pair being nearest to the first heel, toe pair, the repositioned first heel, toe pair being parallel to the azimuth of the boundary segment, and the repositioning causing the first and second heel, toe pairs to form a fan shape by rotating the one end of the first heel, toe pair away from the second heel, toe pair.

2. The computer-implemented method of claim 1, wherein the first and second heel, toe pairs are substantially parallel before repositioning.

3. The computer-implemented method of claim 2, wherein the irregular boundary comprises at least three boundary segments and at least one boundary segment is not parallel and not perpendicular to a planned azimuth for the horizontal wells.

4. The computer-implemented method of claim 1, wherein a length of each of the first and second heel, toe pairs for each respective horizontal well is substantially the same.

5. The computer-implemented method of claim 1, wherein the one or more boundary segments for the irregular boundary that fall within the correct azimuth range are determined by an azimuth for each boundary segment and whether it falls within a maximum change parameter of a planned azimuth for the horizontal wells, but not including the planned azimuth.

6. The computer-implemented method of claim 1, wherein the first heel, toe pair is repositioned by at least one of rotating a farthest endpoint for the first heel, toe pair around a nearest endpoint for the first heel, toe pair by a predetermined angle and shifting the nearest endpoint for the first heel, toe pair and the farthest endpoint for the first heel, toe pair by a predetermined distance.

7. The computer-implemented method of claim 1, wherein the first heel, toe pair is repositioned by pivoting around the heel or the toe for the first heel, toe pair so that a planned azimuth for the horizontal well moves toward an azimuth of a nearest boundary segment.

8. The computer-implemented method of claim 1, further comprising adding or removing another horizontal well.

9. The computer-implemented method of claim 1, further comprising repositioning the second heel, toe pair.

10. The computer-implemented method of claim 1, wherein there are at least two horizontal wells.

11. The computer-implemented method of claim 10, wherein there are at least two horizontal wells for each pad location and there at least two pad locations.

12. A non-transitory program carrier device tangibly carrying computer executable instructions for optimally spacing horizontal wells within an irregular boundary, the instructions being executable to implement:

identifying one or more boundary segments of a hydrocarbon field development, wherein at least one boundary segment of the one or more boundary segments is an irregular boundary, and wherein the hydrocarbon field development includes a plurality of horizontal wells;

positioning a plurality of heel, toe pairs within the hydrocarbon field development having the irregular boundary, each heel, toe pair of the plurality of heel, toe pairs corresponding to a horizontal well of the plurality of horizontal wells, and the plurality of heel, toe pairs including a first heel, toe pair and a second heel, toe pair that are parallel to each other;

selecting the first heel, toe pair from amongst the plurality of heel, toe pairs;

determining whether the irregular boundary is within a correct azimuth range of the first heel, toe pair;

in response to determining that irregular boundary is within the correct azimuth range, determining the first heel, toe pair should be repositioned so as to be parallel to an azimuth of the irregular boundary;

determining a rotation angle to rotate one end of the first heel, toe pair around another end of the first heel, toe pair, the rotation angle being determined so as to reposition the first heel, toe pair to be parallel to the azimuth of a boundary segment of the one or more boundary segments; and repositioning the first heel, toe pair by rotating the one end of the first heel, toe pair by the rotation angle so that the heel, toe pair is not parallel to the second heel, toe pair, the second heel, toe pair being positioned nearest to the first heel, toe pair, the repositioned first heel, toe pair being parallel to the azimuth of the boundary segment, and the repositioning causing the first and second heel, toe pairs to form a fan shape by rotating the one end of the first heel, toe pair away from the second heel, toe pair.

13. The program carrier device of claim 12, wherein the horizontal wells are substantially parallel before repositioning.

14. The program carrier device of claim 13, wherein the irregular boundary comprises at least three boundary segments and at least one boundary segment is not parallel and not perpendicular to a planned azimuth for the horizontal wells.

15. The program carrier device of claim 12, wherein a length of each of the first and second heel, toe pairs for each respective horizontal well is substantially the same.

16. The program carrier device of claim 12, wherein the boundary segments for the irregular boundary that fall within the correct azimuth range are determined by an azimuth for each boundary segment and whether it falls within a maximum change parameter of a planned azimuth for the horizontal wells, but not including the planned azimuth.

17. The program carrier device of claim 12, wherein the first heel, toe pair is repositioned by at least one of rotating a farthest endpoint for the first heel, toe pair around a nearest endpoint for the first heel, toe pair by a predetermined angle and shifting the nearest endpoint for the first heel, toe pair and the farthest endpoint for the first heel, toe pair by a predetermined distance.

18. The program carrier device of claim 12, wherein the first heel, toe pair is repositioned by pivoting around the heel or the toe for the first heel, toe pair so that a planned azimuth for the horizontal well moves toward an azimuth of a nearest boundary segment.

19. The program carrier device of claim 12, further comprising adding or removing another horizontal well.

20. The program carrier device of claim 12, further comprising repositioning the second heel, toe pair.

21. The program carrier device of claim 12, wherein there are at least two horizontal wells.

22. The program carrier device of claim 21, wherein there are at least two horizontal wells for each pad location and there at least two pad locations.

* * * * *